US006051039A

United States Patent [19]

Sugimoto

[11] Patent Number: 6,051,039

[45] Date of Patent: Apr. 18, 2000

[54] DIESEL FUEL COMPOSITIONS

[75] Inventor: Shigeru Sugimoto, Tokyo, Japan

[73] Assignee: The Lubrizol Corporation, Wickliffe, Ohio

[21] Appl. No.: 09/152,880

[22] Filed: Sep. 14, 1998

[51] Int. Cl.[7] ..... C10L 1/18

[52] U.S. Cl. ..... 44/341; 44/385; 44/389; 44/398; 44/399; 44/403; 44/408; 44/409; 44/412; 44/432

[58] Field of Search ..... 44/385, 389, 398, 44/399, 403, 412, 432, 341, 408, 409

[56] References Cited

U.S. PATENT DOCUMENTS

| | | | |
|---|---|---|---|
| 3,720,615 | 3/1973 | Izumi et al. | 44/351 |
| 4,537,602 | 8/1985 | Rossi | 44/370 |
| 4,569,679 | 2/1986 | Rossi | 44/375 |
| 4,728,340 | 3/1988 | Vos | 44/398 |
| 4,737,159 | 4/1988 | Phillips | 44/403 |

FOREIGN PATENT DOCUMENTS

| | | |
|---|---|---|
| 0874039A1 | 10/1998 | European Pat. Off. . |
| 08134476 | 5/1996 | Japan . |
| 8-134476 | 5/1996 | Japan . |

*Primary Examiner*—Jacqueline V. Howard
*Assistant Examiner*—Cephia D. Toomer
*Attorney, Agent, or Firm*—Michael F. Esposito; Samuel B. Laferty

[57] ABSTRACT

This invention relates to a diesel fuel composition containing an additive composition made by admixing at least two components: A) at least one dicarboxylic acid having about 8 to about 500 carbon atoms or a reactive equivalent thereof; and B) at least one amine having about 6 to about 80 carbon atoms. In one embodiment, the additive composition also contains: C) at least one monocarboxylic acid of about 8 to about 28 carbon atoms or a reactive equivalent thereof. The additive composition is useful as a lubricity additive for diesel fuel, especially low sulfur diesel fuel and provide excellent storage stability, rust-inhibiting and anti-wear performance to diesel fuel.

23 Claims, No Drawings

DIESEL FUEL COMPOSITIONS

BACKGROUND OF THE INVENTION

1. Field of the Invention

This invention relates to diesel fuels, more particularly, to diesel fuels compositions containing an additive composition made by admixing at least one dicarboxylic acid, at least one amine and optionally at least one monocarboxylic acid.

2. Description of the Related Art

Low sulfur diesel fuel, defined as having up to 0.05% by weight sulfur content, has been required by law in the U.S. for on-highway use since October 1993 and in Europe since October 1996. Other nations in the Americas and Asia have timetables in place to follow suit. The driving force to low sulfur diesel fuel is the desire to minimize harmful emissions from diesel vehicles. Scientific evidence exists linking diesel fuel sulfur levels to particulate matter emissions from diesel vehicles.

Diesel fuel sulfur level is reduced by hydrotreatment of various distillate streams at the refinery. Hydrotreatment not only removes sulfur, but also removes other polar compounds and polycyclic aromatic compounds normally present in the diesel fuel. These compounds contribute to the natural lubricity of diesel fuel. When these compounds are removed during the hydrotreatment process, the final low sulfur diesel fuel tends to have poor natural lubricity.

Light duty diesel engines are usually fitted with rotary type fuel injection pumps. These pumps are lubricated only by the diesel fuel. Low sulfur fuels having poor natural lubricity have been shown to cause wear in these pumps leading to troublesome operation and premature pump failure. The use of lubricity additives in low sulfur diesel fuels has been shown to reduce or prevent pump wear.

Engine oil contacts diesel fuel in certain types of in-line diesel injection pumps and through direct addition of used engine oil to the fuel. Certain types of lubricity additives used in low sulfur diesel fuel have been found to contribute to fuel filter blockage and to pump plunger sticking. Lubricity additives having poor compatibility with engine oil have been shown to cause these problems. Poor compatibility means that the diesel fuel containing the lubricity additive tends to form fuel insoluble deposits, gels, or heavy sticky residues when in contact with engine oil. These deposits, gels or residues have been shown to cause fuel filter blockage and injection pump sticking.

It would be advantageous to provide a diesel fuel composition that has enhanced lubricity characteristics and is compatible with engine oil. The present invention provides such an advantage. The diesel fuel compositions of the present invention, in addition to having enhanced antiwear performance also have increased storage stability, and enhanced antirust performance.

Japanese laid-open Patent Publication No 8-134476, Takizawa, May 28, 1996, discloses a low sulfur diesel fuel composition, comprising a low sulfur diesel fuel having a sulfur content of 0.05% by weight, and 5–500 mg/L of at least one of a dicarboxylic acid salt of an alkylene diamine, said dicarboxylic acid having a saturated or unsaturated hydrocarbon group of 5–28 carbon atoms and said alkylene diamine having one amino group substituted by a saturated or unsaturated hydrocarbon group of 5–28 carbon atoms; a monocarboxylic acid salt of an alkylene diamine, said monocarboxylic acid having a saturated or unsaturated hydrocarbon group of 5–28 carbon atoms; and a carboxylic acid salt of a monoamine, said carboxylic acid having a saturated or unsaturated hydrocarbon group of 5–28 carbon atoms and said monoamine having a saturated or unsaturated hydrocarbon group of 5–28 carbon atoms. This composition is disclosed to provide excellent anti-wear property and excellent sliding property.

SUMMARY OF THE INVENTION

This invention relates to diesel fuel compositions comprising a major amount of a diesel fuel and a minor lubricity enhancing amount of an additive composition prepared by admixing at least two components comprising: A) at least one dicarboxylic acid having about 8 to about 500 carbon atoms, or a reactive equivalent thereof; and B) at least one amine having about 6 to about 80 carbon atoms. In one embodiment, the components further comprises (C) at least one monocarboxylic acid of about 8 to about 28 carbon atoms. The diesel fuel compositions also provides excellent storage stability, rust-inhibiting and anti-wear performance.

DETAILED DESCRIPTION OF THE INVENTION

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

A hydrocarbylene group is a divalent hydrocarbyl group. Examples include methylene ($—CH_2—$), ethylene ($—CH_2CH_2—$) and 1,2-propylene ($—CH_2CH(CH_3)—$).

The term "lower" as used herein in conjunction with terms such as hydrocarbyl, alkyl, and alkenyl is intended to describe such groups which contain a total of up to 7 carbon atoms The phrase "reactive equivalent" of a material means any compound or chemical composition other than the material itself which reacts or behaves like the material itself under the reaction conditions. Thus for example, reactive equivalents of carboxylic acids include acid-producing derivatives such as acid halides, anhydrides and partial and full esters, including triglycerides.

The phrase "lubricity enhancing amount" refers to any amount of an additive that is sufficient to provide the present diesel fuels with enhanced lubricity. One way to measure the lubricity enhancing characteristic of an additive is by means of a wear test. The antiwear property of the diesel fuel composition containing the lubricity enhancer/improver is generally superior compared to the diesel fuel alone.

The Dicarboxylic Acid (A)

One component being used to form the additive composition of this invention is a dicarboxylic acid having about 8 to about 500 carbon atoms, and in one embodiment from about 10 to about 400, and one embodiment about 12 to about 300, and in one embodiment from about 12 to about 200, and in one embodiment from about 12 to about 20 carbon atom. Reactive equivalents of said dicarboxylic acid is also within the scope of this invention.

Reactive equivalents of these dicarboxylic acids include acid producing compounds such as anhydrides, and partial esters (such as half acid, half ester). A partial ester can be represented by the formula (A-I)

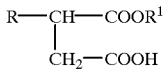

wherein in formula (A-I) R is a hydrocarbyl group; and $R^1$ is a hydrocarbyl group, typically a lower alkyl group.

In one embodiment, component (A) can be represented by the formula (A-II)

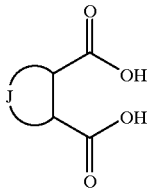

wherein in formula (A-II) J is a hydrocarbylene group having about about 4 to about 496 carbon atoms, and in one embodiment about 4 to about 100 carbon atoms, and in one embodiment about 4 to about 30 carbon atoms that forms a cyclic structure with the rest of the formula (A)(II) as shown.

In one embodiment, formula (A)(II) can be more specifically represented by the formula (A-III)

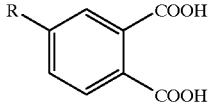

wherein in formula (A-III), R is hydrogen or a hydrocarbyl group of 1 to about 492 carbon atoms, and in one embodiment about 6 to about 30 carbon atoms.

In one embodiment, component (A) can be represented by the formula (A-IV)

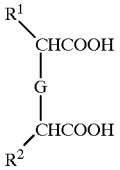

or a reactive equivalent thereof; wherein in formula (A-IV), $R^1$ and $R^2$ are independently selected from the group consisting of hydrogen and hydrocarbyl groups of 1 to about 490 carbon atoms, and in one embodiment from 1 to about 12, in one embodiment from about 10 to about 50, and in one embodiment from about 50 to about 400 carbon atoms; and G is a hydrocarbylene group of 1 to about 8 carbon atoms, and in one embodiment from 2 to 4, and in one embodiment from 4 to 6, and in one embodiment from 6 to 8 carbon atoms; or a direct link between the —CH($R^1$)COOH and —CH($R^2$)COOH groups as in the formula (A-V)

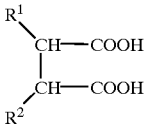

provided that the total number of carbon atoms in the dicarboxylic acid (A-V) is about 12 to about 500 carbon atoms.

Examples of compounds of formula (A-IV) include succinic acid, glutaric acid, adipic acid, pimelic acid, suberic acid, azelaic acid, sebacic acid, and hydrocarbyl substituted derivatives of said acids.

In one embodiment, component (A) include hydrocarbyl substituted succinic acids and anhydrides. The succinic acids can be represented by the formula (A-VI)

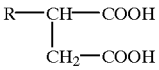

and the succinic anhydrides by the formula (A-VII)

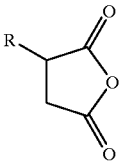

wherein in each of formulae (A-VI) and (A-VII), R is a hydrocarbyl group of about 8 to about 495 carbon atoms, and in one embodiment about 10 to 400, and in one embodiment about 12 to about 300, and in one embodiment about 12 to 200, and in one embodiment about 12 to about 20 carbon atoms. These include tetrapropenyl-substituted succinic acid and anhydride. The production of such substituted succinic acids and their derivatives via alkylation of maleic acid or its derivatives with a halohydrocarbon is well known to those of skill in the art and need not be discussed in detail herein.

Partial esters of the succinic acids or anhydrides represented by Formulae (A-VI) and (A-VIII) can be prepared simply by the reaction of the acid or anhydride with an alcohol or phenolic compound. Particularly useful are the lower alkyl and alkenyl alcohols such as methanol, ethanol, allyl alcohol, propanol, cyclohexanol, etc. Esterification reactions are usually promoted by the use of alkaline catalysts such as sodium hydroxide or alkoxide, or an acidic catalyst such as sulfuric acid or toluene sulfonic acid.

In one embodiment, the hydrocarbyl substituent of the hydrocarbyl substituted succinic acid of formula (A-VI) is an alkyl or alkenyl group.

In one embodiment, the hydorcarbyl substituent of the hydrocarbyl substituted succinic acid of formula (A-VI) and the succinic anhydride of formula (A-VII) may be derived from olefin polymers or chlorinated analogs thereof. These substituents can be straight chained or branched chained. They typically have an average of at least about 30 carbon atoms per molecule, and in one embodiment an average of at least about 40 carbon atoms, and in one embodiment an average of at least about 50 carbon atoms. In one embodiment, these substituents have an average of from about 30 to about 500 carbon atoms per molecule, and in one embodiment about 100 to about 200 carbon atoms, and in one embodiment about 50 to about 100 carbon atoms, and in one embodiment from about 200 to 495 carbon atoms.

The olefin monomers from which the olefin polymers are derived are polymerizable olefin monomers characterized by having one or more ethylenic unsaturated groups. They can be monoolefinic monomers such as ethylene, propylene, butene-1, isobutene and octene-1 or polyolefinic monomers (usually di-olefinic monomers such as butadiene-1,3 and isoprene). Usually these monomers are terminal olefins, that is, olefins characterized by the presence of the group $>C{=}CH_2$. However, certain internal olefins can also serve as monomers (these are sometimes referred to as medial olefins). When such medial olefin monomers are used, they normally are employed in combination with terminal olefins to produce olefin polymers which are interpolymers. Although, the hydrocarbyl substituents may also include aromatic groups (especially phenyl groups and lower alkyl and/or lower alkoxy-substituted phenyl groups such as para (tertiarybutyl)-phenyl groups) and alicyclic groups such as would be obtained from polymerizable cyclic olefins or alicyclic-substituted polymerizable cyclic olefins, the hydrocarbyl-based substituents are usually free from such groups. Nevertheless, olefin polymers derived from such interpolymers of both 1,3-dienes and styrenes such as butadiene-1,3 and styrene or para-(tertiary butyl) styrene are exceptions to this general rule.

Generally the olefin polymers are homo- or interpolymers of terminal hydrocarbyl olefins of about 2 to about 30 carbon atoms, and in one embodiment about 2 to about 16 carbon atoms. A more typical class of olefin polymers is selected from that group consisting of homo- and interpolymers of terminal olefins of 2 to about 6 carbon atoms, and in one embodiment 2 to about 4 carbon atoms.

Specific examples of terminal and medial olefin monomers which can be used to prepare the olefin polymers from which the hydrocarbyl-based substituents are derived include ethylene, propylene, butene-1, butene-2, isobutene, pentene-1, hexene-1, heptene-1, octene-1, nonene-1, decene-1, pentene-2, propylene tetramer, diisobutylene, isobutylene trimer, butadiene-1,2, butadiene-1,3, pentadiene-1,2, pentadiene-1,3, isoprene, hexadiene-1,5, 2-chlorobutadiene-1,3, 2-methylheptene-1, 3-cyclohexylbutene-1, 3,3-dimethylpentene-1, styrenedivinylbenzene, vinyl-acetate allyl alcohol, 1-methylvinylacetate, acrylonitrile, ethyl acrylate, ethylvinylether and methylvinylketone. Of these, the purely hydrocarbyl monomers are more typical and the terminal olefin monomers are especially typical.

Often the olefin polymers are polyisobutylenes (polyisobutene) such as those obtained by polymerization of a $C_4$ refinery stream having a butene content of about 35 to about 75% by weight and an isobutene content of about 30 to about 60% by weight in the presence of a Lewis acid catalyst such as aluminum chloride or boron trifluoride. These polyisobutylenes generally contain predominantly (that is, greater than about 50 percent of the total repeat units) isobutene repeat units of the configuration

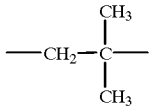

Gel permeation chromatography (GPC) (also known as size exclusion chromatography (SEC)) is a method which can provide both weight average and number average molecular weights as well as the entire molecular weight distribution of polymers. For purposes of this invention, a series of fractionated polymers of isobutene is used as the calibration standard in the GPC. The techniques for determining number average molecular weight (Mn) and weight average molecular weight (Mw) of polymers are well known and are described in numerous books and articles. For example, methods for the determination of Mn and molecular weight distribution of polymers is described in W. W. Yan, J. J. Kirkland and D. D. Bly, "Modern Size Exclusion Liquid Chromatography", J. Wiley & Sons, Inc., 1979.

In addition to being described in term of carbon numbers, the polyolefin substituents of the hydrocarbyl substituted succinic acids and anhydrides of this invention can also be described in terms of their number average and/or weight average molecular weights. An approximate method to convert the number average molecular weight of the polyolefin to number of carbon atoms is to divide the number average molecular weight by 14.

The Amine (B)

Another component of the present composition used to form the the additive composition of the present invention is at least one amine having about 6 to about 80 carbon atoms, and in one embodiment about 6 to about 40 carbon atoms, and in one embodiment about 6 to about 24 carbon atoms, and in one embodiment about 6 to about 18 carbon atoms.

The amine can be may be a monoamine or a polyamine (such as a diamine, triamine, tetramine or pentamine). The amine can be a primary, secondary or tertiary amine. The primary and secondary monoamines and polyamines are characterized by the presence within their structure of at least one H—N<group. Therefore, they have at least one primary (i.e.,$H_2N$—) or secondary amine (i.e., 1 H—N<) group.

In one embodiment, component (B) is represented by the formula $$R^3R^4N(LNH)_mH \qquad \text{(B-I)}$$

wherein in formula (B-I), $R^3$is a straight chain hydrocarbyl group of about 6 to about 24 carbon atoms, and in one embodiment from about 6 to about 18 carbon atoms; $R^4$ is hydrogen or a hydrocarbyl group of about 6 to about 24 carbon atoms and in one embodiment from about 6 to about 18 carbon atoms; L is an alkylene group of about 2 to about 6 carbon atoms; and m is a number from 0 to about 4.

Specific examples of primary amines within the scope of formula (B-I) wherein m=0, include hexyl amine, octyl amine, decyl amine, lauryl amine, myristyl amine, cetyl amine, stearyl amine, oleyl amine, and tallow amine.

Also included within the scope of amines represented by formula (B-I) are secondary monoamines having two hydrocarbyl groups, wherein the hydrocarbyl groups may be the same or different. Specific examples of these types of secondary monoamines include dioctylamine, N-octyl-N-decylamine, didecylamine, N-nonyl-N-decylamine, didecylamine, N-decyl-N-dodecylamine, and dioctadecylamine.

Amines represented by formula (B-I) also include diamines (m in formula (B-I) being 2) obtained for example by reacting primary monoamines with acrylonitrile followed by hydrogenation. Specific examples of these diamines include N-aminopropyldecyl amine, N-propyllauryl amine, N-aminopropylmyristyl amine, N-aminopropylcetyl amine, N-aminopropylstearyl amine, and N-aminopropyltallow amine.

The triamines include for example N-decyldipropylene triamine, laurtyldipropylene triamine, N-myristyldipropylene triamine, N-cetyldipropylene triamine, N-stearyldipropylene triamine, and N-tallowdipropylene triamine.

The tetramines include N-lauryltripropylene tetramine, N-myristyltripropylene tetramine, N-cetyltripropylene tetramine, N-stearyltrirpylene tetramine, and N-tallowtripropylene tetramine.

The pentamines include N-lauryltetrapropylene tetramine, N-myristyltetrapropylene tetramine, N-stearyltetrapropylene tetramine, and N-tallowtetrapropylene tetramine.

Similarly, diamines, triamines, tetramines and pentamines derived from secondary monoamines can also be used.

The amines represented by the formula (B-I) include preferably those in which $R^3$ and/or $R^4$ have a carbon number of about 6 to about 24, more preferably about 8 to about 22, and still more preferably about 8 to about 20. The most preferred are primary monoamines and diamines having a carbon number of about 8 to about 18.

Levels of Components (A) and (B):

Components (A) and (B) can be present at any amounts provided that the additive composition formed from admixing these components is present at a minor lubricating enhancing amount, as defined hereinbefore. In one embodiment, component (A) is present at a level of about 0.5 to about 99%, and in one embodiment about 0.5 to 75%, and in one embodiment about 0.5 to about 50%, and in one embodiment about 0.5 to about 30%, and in one embodiment about 0.5 to about 10%, by weight of the additive composition. In one embodiment, component (B) is present at a leval of about 0.2 to about 99%, and in one embodiment from about 0.2 to about 75%, and in one embodiment about 0.2 to about 50%, and in one embodiment about 0.5 to about 10% by weight of the additive composition.

With regard to components (A) and (B), it is preferred that $$\frac{\text{Acid number of component } (A) \times P}{\text{Amine number of component } (B) \times (1-P)} = N = 0.05-20; \quad \text{(equation 1)}$$

wherein $$P = \frac{\text{Weight of Component } A}{\text{Weight of component } (A) + \text{Weight of component } (B)} \quad \text{(equation 2)}$$

More preferably, N ranges from about 0.1 to about 10, still more preferably about 0.2 to about 5, and most preferably about 0.4 to about 2.

Monocarboxylic Acid (C)

Component (C) of the present additive composition comprises at least one monocarboxylic acid of about 8 to about 30 carbon atoms, and in one embodiment from about 8 to about 24, and in one embodiment form about 12 to about 24 carbon atoms. Mixtures of acids within the foregoing description can also be used as component (C). Component (C) includes both saturated and unsaturated fatty acids. In one embodiment the fatty acid is a straight chain fatty acid.

Examples of useful saturated fatty acids include decanoic acid, lauric acid, myristic acid, palmitic acid, stearic acid, arachic acid, and behenic acid. Examples of useful unsaturated fatty acids include oleic acid, erucic acid, linoelaidic acid, linoleic acid, and linolenic acid. These fatty acids may be used alone, or two or more of these may be mixed and used. Among these fatty acids, oleic acid is especially preferred in the present invention in view of its anti-wear performance and solubility in diesel fuel.

Component (C) may be present in any amount provided that the additive composition formed from admixing (C) with the other components (A) and (B) is present at a minor lubricating enhancing amount, as defined hereinbefore. In one embodiment, component (C) is present at a level of about 0.5 to about 99%, and in one embodiment from about 20 to about 90%, and in one embodiment from about 60 to about 80% of the additive composition.

In one embodiment, the amount of component (C) is governed by the expression:

$$\text{Weight of component } (C) = \frac{\text{Weight of component } (A) + \text{Weight of component } (B)}{K} \quad \text{(equation 3)}$$

wherein K ranges from about 0.005 to 1, and in one embodiment 0.01 to about 0.5, and in one embodiment from about 0.02 to about 0.4, and in one embodiment from about 0.04 to about 0.3. In one embodiment, in a blend of (A), (B), and (C), the weight ratio of component (A) to component (B) may range from 1 to about 20, and in one embodiment from 1 to about 5, and in one embodiment from 1 to 2.5, and in one embodiment from 1 to 2.

The Additive Composition

The additive composition of the present invention is made by admixing at least two components comprising components (A), and (B), and in one embodiment further comprising component (C). The admixing can take place in the presence of diesel fuel after after each component is added separately to diesel fuel, or it may take place prior to contact with diesel fuel, i.e., the components are first premixed to form a concentrate, and then the concentrate is added to the diesel fuel. In the first case, where the admixing takes place in the presence of the diesel fuel, the additive composition forms in the presence of the diesel fuel after the components are in contact with the diesel fuel. In the second case, where the admixing takes place prior to contact of the components with diesel fuel, the additive composition is first preformed and the preformed additive composition is added to the diesel fuel as a concentrate.

The additive composition can be a physical mixture of the components ((A) and (B); or (A), (B) and (C)), a reaction product that may be formed by a reaction of the components, or mixtures of reaction products and unreacted components. The reaction may take place during the admixing of the components either at room temperature or in the presence of other conditions, such as the application of heat.

In one embodiment of the invention, the reaction product is a salt compound (typically a carboxylic acid-amine salt) formed by the reaction of the acidic and amine components. However other reaction products such as amides, imides, nitrogen containing ring compounds, and mixtures thereof are also within the scope of the invention. Generally these other non-salt reaction products are formed at temperatures higher than ambient temperatures, although mixtures of salts and these other non-salt reaction products are also possible.

The additive composition is present at a minor lubricating enhancing amount, as defined hereinbefore. In one embodiment, the additive composition is present at a level of about 0.001 part to about 0.1 part, and in one embodiment from about 0.001 part to about 0.05 part, and in one embodiment from about 0.001 to about 0.02 part per 100 parts by weight of the diesel fuel when component (C) is used to make the additive composition. When component (C) is not used (i.e. the additive composition is made by admixing components comprising (A) and (B), the additive composition is present at a level of about 0.001 part to about 0.5 part, and in one embodiment from about 0.002 part to about 0.02 part per 100 parts by weight of the diesel fuel.

It is preferred that for the purpose of improving only the rust-inhibiting performance of a diesel fuel, the additive composition, when component (C) is not used, is present at a level of about 0.0001 to about 0.1 part, and in one embodiment about 0.0001 to about 0.5 part per 100 parts by weight of the diesel fuel. However, for the purpose of improving only the anti-wear performance of a diesel fuel composition, it is preferred that the additive composition, when component (C) is not used, is present at a level of about 0.001 to 0.05 part, and in one embodiment about 0.002 part to about 0.02 part per 100 parts by weight of the diesel fuel.

The Diesel Fuel

The diesel fuels that are useful with this invention can be any diesel fuel. The diesel fuel consitutes the major proportion (at least about 90% by weight; and in one embodiment at least about 95% by weight) of the diesel fuel composition of the present invention. The diesel fuel includes those that are defined by ASTM Specification D396. In one embodiment the diesel fuel has a sulfur content of up to about 0.05% by weight (low sulfur diesel fuel) as determined by the test method specified in ASTM D 2622-87 entitled "Standard Test Method for Sulfur in Petroleum Products by X-Ray Spectrometry". Any fuel having a boiling range and viscosity suitable for use in a diesel-type engine can be used. These fuels typically have a 90% point distillation temperature in the range of about 300° C. to about 390° C., and in one embodiment about 330° C. to about 350° C. The viscosity of diesel fuels typically ranges from about 1.3 to about 24 centistokes at 40° C. Thee diesel fuels can be classified as any of Grade Nos. 1-D, 2-D or 4-D as specified in ASTM D 975 entitled "Standard Specification for Diesel Fuel Oils". Thee diesel fuels can contain alcohols and esters.

The low sulfur diesel fuels (diesel fuels having a sulfur content of up to 0.05% by weight) of this invention include those obtained by such methods as the hydrodesulfurization of the diesel fuel fraction (which is obtained by the atmospheric distillation of crude oil) at a high reaction temperature, under a high hydrogen partial pressure, or using a highly active hydrodesulfurization catalyst, but the desulfurization method is not specifically limited, in so far as the sulfur content is about 0.05% or less by weight.

In addition to the components already disclosed, the diesel fuel compositions of the present invention may contain other additives known in the art that are suitable for used with a diesel fuel. These include antioxidants, metal deactivators, anti-icing additives, cetane improvers, combustion improvers (including smoke controlling agents), surfactant/dispersant additives, intake system detergents, corrosion inhibitors, demulsifiers, top cylinder lubricants, and dyes.

The additive composition in addition to being effective as a lubricity improver for diesel fuel is also effective for improving the storage stability, and rust-inhibiting performance of diesel fuel. It is also useful as an additive to control the formation of deposits in diesel engines.

EXAMPLES

The following examples illustrate in more detail various embodiments of the present inventive compositions as lubricity additives for diesel fuels. In the following examples, as well as throught the specification and claims, unless otherwide indicated, all parts and percentages are by weight, all temperatures are in degrees Celsius, and all pressures are atomospheric.

Tables 1 and 2 and 3 list several compositions that were evaluated separately in diesel fuel storage stability, rust-inhibiting and antiwear tests.

TABLE 1

| | Component A | Component B | Value of N[1] |
|---|---|---|---|
| Example Product 1 | Dodecenyl succinic acid (acid value is ~395) | Lauryl amine (amine value ~305) | 1 |
| Example Product 2 | Dodecenyl succinic acid (acid value is ~395) | Oleyl amine (amine value ~210) | 1 |
| Example Product 3 | Dodecenyl succinic acid (acid value is ~395) | N-amiopropyl tallowamine (amine value ~335) | 1 |
| Example Product 4 | A polyisobutylene (Mn about 1000; average carbon number ~70) substituted succinic acid (acid value; 20)[2] | Lauryl amine (amine value ~305) | 1 |
| Example Product 5 | A polyisobutylene (Mn about 1000; average carbon number ~70) substituted succinic acid (acid value; 20)[2] | Oleyl amine (amine value ~210) | 0.2 |
| Example Product 6 | A polyisobutylene (Mn about 1000; average carbon number ~70) substituted succinic acid (acid value; 20)[2] | Oleyl amine (amine value ~210) | 1 |

TABLE 1-continued

| | Component A | Component B | Value of N[1] |
|---|---|---|---|
| Example Product 7 | A polyisobutylene (Mn about 1000; average carbon number ~70) substituted succinic acid (acid value; 20)[2] | Oleyl amine (amine value ~210) | 3 |
| Example Product 8 | A polyisobutylene (Mn about 1000; average carbon number ~70) substituted succinic acid (acid value; 20)[2] | N-amiopropyl tallowamine (amine value ~335) | 0.2 |
| Example Product 9 | A polyisobutylene (Mn about 1000; average carbon number ~70) substituted succinic acid (acid value; 20)[2] | N-amiopropyl tallowamine (amine value ~335) | 1 |
| Example Product 10 | A polyisobutylene (Mn about 1000; average carbon number ~70) substituted succinic acid (acid value; 20)[2] | N-amiopropyl tallowamine (amine value ~335) | 3 |

[1]Equation 1;
[2]contains 66% aromatic solvent, and 9% diluent oil.

TABLE 2

| | Component A | Component B | Value of N | Component C | Value of K[1] |
|---|---|---|---|---|---|
| Example Product 11 | Dodecenyl succinic acid (acid value ~395) | Oleyl amine (amine value ~210) | 1 | Palmitic acid | 0.2 |
| Example Product 12 | Dodecenyl succinic acid (acid value ~395) | Oleyl amine (amine value ~210) | 1 | Oleic acid | 0.2 |
| Example Product 13 | A polyisobutylene (Mn ~1000; average carbon number ~70) substituted succinic acid (acid value; 20)[2] | Oleyl amine (amine value ~210) | 1 | " | 0.2 |
| Example Product 14 | A polyisobutylene (Mn ~1000; average carbon number ~70) substituted succinic acid (acid value; 20)[2] | Oleyl amine (amine value ~210) | 2.5 | " | 0.2 |
| Example Product 15 | A polyisobutylene (Mn ~1000; average carbon number ~70) substituted succinic acid (acid value; 20)[2] | N-amiopropyl tallowamine (amine value ~335) | 1 | " | 0.2 |
| Example Product 16 | A polyisobutylene (Mn ~1000; average carbon number ~70) substituted succinic acid (acid value; 20)[2] | N-amiopropyl tallowamine (amine value ~335) | 1 | Erucic acid | 0.5 |
| Example Product 17 | A polyisobutylene (Mn ~1000; average carbon number ~70) substituted succinic acid (acid value; 20)[2] | N-amiopropyl tallowamine (amine value ~335) | 2.5 | " | 0.2 |
| Example Product 18 | A polyisobutylene (Mn ~1000; average carbon number ~70) substituted succinic acid (acid value; 20)[2] | Octylamine | 0.4 | Oleic acid | 0.5 |

[1]Equation 3; K = (Weight of A + B)/Weight of C;
[2]contains 66% aromatic solvent, and 9% diluent oil.

The amine value in Tables 1 and 2 above represents the number of milligrams of potassium hydroxide that correspond to equivalents of hydrochloric acid required to neutralize 1 gram of the sample of the amine. This is also known as the base number and can be measured by the standard test D2896, or a modified version of this test.

The acid value represents the number of milligrams of potassium hydroxide that correspond to the equivalents of potassium hydroxide required to neutralize 1 gram of the sample of the acid, and can be measured by the standard test ASTM D-664.

TABLE 3

| | |
|---|---|
| Comparative Example Product 1 | Dodecenyl succinic acid (acid value ~395) |
| Comparative Example Product 2 | A polyisobutylene (Mn ~1000; average carbon number ~70) substituted succinic acid (acid value 20)[1] |
| Comparative Example Product 3 | Lauryl amine (amine value ~305) |
| Comparative Example Product 4 | Oleyl amine (amine value ~210) |

TABLE 3-continued

| | |
|---|---|
| Comparative Example Product 5 | N-amiopropyl tallowamine (amine value ~335) |
| Comparative Example Product 6 | Palmitic acid |
| Comparative Example Product 7 | Oleic acid |
| Comparative Example Product 8 | Erucic acid |

[1]contains 66% aromatic solvent, and 9% diluent oil.

Storage Stability Test Results

The example products of tables 1 and 2, and the comparative example products of table 3 are added to a diesel fuel having a sulfur content of about 0.04% by weight, and allowed to stand at 60° C. under the exposure to light to determine the number of days until precipitates start forming in the diesel fuel (i.e. to determine the storage stability of the various additives). This method is similar to test method ASTM D-2274 with modifications. The results are depicted in Table 4.

TABLE 4

| Examples | Example Products | Addition Amounts (ppm) | Number of days until precipitates start depositing |
|---|---|---|---|
| 1 | 1 | 20 | 6 |
| 2 | 2 | 20 | 6 |
| 3 | 3 | 20 | 7 |
| 4 | 4 | 20 | 8 |
| 5 | 5 | 20 | 6 |
| 6 | 6 | 20 | 9 |
| 7 | 7 | 20 | 8 |
| 8 | 8 | 20 | 6 |
| 9 | 9 | 20 | 10 |
| 10 | 10 | 20 | 9 |
| 11 | 11 | 100 | 6 |
| 12 | 12 | 100 | 6 |
| 13 | 13 | 100 | 9 |
| 14 | 14 | 100 | 7 |
| 15 | 15 | 100 | 10 |
| 16 | 16 | 100 | 10 |
| 17 | 17 | 100 | 8 |
| 18 | 18 | 100 | 8 |

| Comparative Examples | Comparative Example Products | Addition Amounts (ppm) | Number of days until precipitates start depositing |
|---|---|---|---|
| 1 | non-additive | | 4 |
| 2 | 1 | 20 | 4 |
| 3 | 2 | 20 | 4 |
| 4 | 3 | 20 | 4 |
| 5 | 4 | 20 | 4 |
| 6 | 5 | 90 | 2 |
| 7 | 6 | 90 | 2 |
| 8 | 7 | 90 | 3 |

The results of the storage stability test in Table 4 indicate that the addition of the Example products of Tables 1 and 2 extend the number of days passed before insolubles start forming. This indicates that diesel fuel compositions of the present invention have excellent storage stability characteristics compared to non-additized diesel fuel (i.e., diesel fuel without the additive composition) and compared to diesel fuel additized with the composition of the comparative examples 1–7. Also, it can be seen from Table 4, that the addition of component C alone to the diesel fuel shortens the number of days (compared to the non-additized diesel fuel) until insolubles start forming (comparative examples 7 and 8 in Table 4), but the addition of the mixture of components (A) and (B), and the mixture of components (A), (B), and (C) extend the number of days until insolubles start forming to improve the storage stability of the diesel fuel.

Evaluation of Additives as Rust-Inhibitors

To a 500 mL beaker, 300 mL of a diesel fuel having a sulfur content of 0.04% by weight to which the prescribed amount of each of the Example products and Comparative Example products is added, and 30 mL of an ion exchange water are charged. Then, about half of 20 mm×80 mm iron plate test piece (polished with AA-400 abrasive paper before the test) is immersed into the liquid, and the liquid is maintained at 40±1° C. and stirred with a stirrer for 12 hours. The rust condition of the test piece is evaluated in 12 hours. This method is similar to ASTM D-665 with modifications. The results are shown in Table 5. The evaluation is made based on the following criteria: No generation of rust, ⊗; Partial generation of rust, Ø; Generation of rust on ⅓ of the test piece ▽; Generation of rust on half of the test piece,x.

TABLE 5

| Examples | Example Products | Addition Amounts (ppm) | Rust-inhibiting Property |
|---|---|---|---|
| 18 | 1 | 20 | ⊗ |
| 19 | 2 | 20 | ⊗ |
| 20 | 3 | 20 | ⊗ |
| 21 | 4 | 20 | ⊗ |
| 22 | 5 | 20 | Ø |
| 23 | 6 | 20 | ⊗ |
| 24 | 7 | 20 | ⊗ |
| 25 | 8 | 20 | Ø |
| 26 | 9 | 20 | ⊗ |
| 27 | 10 | 20 | ⊗ |
| 28 | 11 | 100 | ⊗ |
| 29 | 12 | 100 | ⊗ |
| 30 | 13 | 100 | ⊗ |
| 31 | 14 | 100 | Ø |
| 32 | 15 | 100 | ⊗ |
| 33 | 16 | 100 | ⊗ |
| 34 | 17 | 100 | Ø |
| 35 | 18 | 100 | ⊗ |

| Comparative Examples | Comparative Example Products | Addition Amounts (ppm) | Rust-inhibiting Property |
|---|---|---|---|
| 9 | non-additive | | x |
| 10 | 1 | 20 | ▽ |
| 11 | 2 | 20 | ▽ |
| 12 | 3 | 20 | ▽ |
| 13 | 5 | 90 | ▽ |
| 14 | 6 | 90 | x |
| 15 | 7 | 90 | x |

The results from Table 5 indicate that the diesel fuel compositions of the present invention have better rust-inhibiting property compared to non-additized diesel fuel and compared to diesel fuel compositions containing comparative example products 1–7 which contain only one component of the present additive composition.

Evaluation of Wear-Reducing Effect

The Soda-type pendulum test is conducted in order to determine the anti-wear property of the present diesel fuel compositions. A ball and a pin are immersed into a diesel fuel composition having a sulfur content of 0.04% by weight to which each of the Example products and Comparative Example products is added, and the measurement of coefficient of friction is made from the attenuation factor of the pendulum. This test is conducted according to ASTM D6079 or a modification thereof. The results are shown in tables 6 and 7 below.

Table 6 shows the effect of the blend of components (A) and (B) while table 7 shows the effect of the blends of components (A), (B), and (C).

TABLE 6

| Examples | Example Products | Addition Amounts (ppm) | Coefficient of friction |
|---|---|---|---|
| 36 | 1 | 50 | 0.282 |
| 37 | 2 | 50 | 0.265 |
| 38 | 3 | 50 | 0.249 |
| 39 | 4 | 50 | 0.283 |
| 40 | 6 | 50 | 0.271 |
| 41 | 9 | 50 | 0.253 |
| **Comparative Example** | **Comparative Example Product** | **Addition Amount (ppm)** | **Coefficient of friction** |
| 16 | no additive | | 0.358 |

The results of Table 6 indicate that the addition of components (A) and (B) to the diesel fuel lower the coefficient of friction of the fuel from about 0.358 to about 0.249–0.282.

TABLE 7

| Examples | Example Products | Addition Amounts (ppm) | Coefficient of friction |
|---|---|---|---|
| 42 | 11 | 50 | 0.175 |
| 43 | 12 | 50 | 0.163 |
| 44 | 13 | 50 | 0.146 |
| 45 | 14 | 50 | 0.159 |
| 46 | 15 | 50 | 0.145 |
| 47 | 16 | 50 | 0.160 |
| 48 | 17 | 50 | 0.167 |
| 49 | 18 | 50 | 0.168 |
| **Comparative Examples** | **Comparative Example Products** | **Addition Amounts (ppm)** | **Coefficient of friction** |
| 17 | 6 | 50 | 0.211 |
| 18 | 7 | 50 | 0.201 |
| 19 | 8 | 50 | 0.209 |

The results of Table 7 indicate that the addition of components (A), (B) and (C) to a diesel fuel greatly reduces its coefficient of friction from about 0.358 to about 0.149–0.175. Furthermore, the coefficient of friction is also reduced when compared to compositions which only have component (C) in the diesel fuel (comparative examples 17–19).

All of the results taken together demonstrate that the additive compositions of the present invention provide excellent storage stability, rust-inhibiting performance and anti-wear performance to diesel fuels.

Each of the documents referred to above is incorporated herein by reference. Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the amount, range, and ratio limits set forth herein may be combined.

What is claimed is:

1. A diesel fuel composition comprising a major amount of a diesel fuel and a minor lubricity enhancing amount of an additive composition prepared by admixing at least two components comprising:

(A) at least one dicarboxylic acid selected from the group consisting of (a) hydrocarbyl-substituted succinic acids and anhydrides represented respectively by the formulae (A-VI)

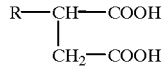

and (A-VII)

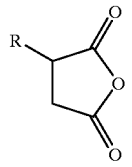

wherein in formulae (A-VI) and (A-VII), R is a hydrocarbyl group of about 30 to about 495 carbon atoms and reactive equivalents of said succinic acids and anhydrides;

(b) phthalic acids represented by the formula (A-II)

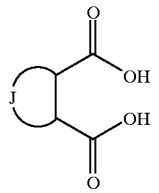

or reactive equivalents thereof, wherein in formula (A-II), J is a hydrocarbylene group of about 4 to about 496 carbon atoms that forms a cyclic structure with the rest of the formula as shown; and (c) mixtures of (a) and (b); and (B) at least one amine represented by the formula $R^3HN(LNH)_mH$ wherein $R^3$ is a straight chain hydrocarbyl group of about 6 to about 24 carbon atoms; L is an alkylene group of about 2 to about 6 carbon atoms; and m is a number from 0 to about 4.

2. The composition of claim 1 wherein the admixing of the components to prepare the additive composition takes place prior to contact of said components with diesel fuel.

3. The composition of claim 1 wherein the admixing of the components to prepare the additive composition takes place after contact of said components with the diesel fuel.

4. The composition of claim 1 wherein R is a hydrocarbyl group of at least about 50 carbon atoms.

5. The composition of claim 1 wherein R is a polyisobutene group.

6. The composition of claim 1 wherein the phthalic acid is represented by the formula (A-III)

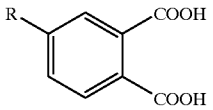

wherein in formula (A-III), R is hydrogen or a hydrocarbyl group.

7. The composition of claim 1 wherein the amine (B) is selected from the group consisting of hexylamine, octylamine, decylamine, laurylamine, myristylamine, hexadecylamine, stearylamine, oleylamine, tallowamine, and hydrogenated tallowamine.

8. The composition of claim 1 wherein both $R^3$ and $R^4$ are hydrogen and m is 1.

9. The composition of claim 1 wherein the relative amounts of components (A) and (B) are governed by the expressions:

$$\frac{\text{Acid number of component } (A) \times P}{\text{Amine number of component } (B) \times (1-P)} = N$$

wherein N ranges from about 0.03 to about 20; and $$P = \frac{\text{Weight of Component } A}{\text{Weight of component } (A) + \text{Weight of component } (B)}$$

10. The composition of claim 1 wherein the components further comprise:

(C) at least one monocarboxylic acid of about 8 to about 28 carbon atoms.

11. The composition of claim 10 wherein component (C) is a fatty acid.

12. The composition of claim 10 wherein component (C) is selected from the group consisting of palmitic acid, lauric acid, stearic acid, oleic acid, myristic acid, linoleic acid, linolenic acid, and mixtures of two or more thereof.

13. The composition of claim 10 wherein the amount of component (C) in the composition is given by the expression:

$$\text{Weight of component } (C) = \frac{\text{Weight of component } (A) + \text{Weight of component } (B)}{K}$$

wherein K ranges from about 0.005 to about 1.

14. The composition of claim 1 wherein the sulfur content of the diesel fuel is up to about 0.05% by weight.

15. The composition of claim 1 wherein the additive composition is present at a level of about 0.001 to about 0.1 part per 100 parts by weight of the diesel fuel.

16. The composition of claim 10 wherein the additive composition is present at a level of about 0.001 part to about 0.05 part per 100 parts by weight of the diesel fuel.

17. The composition of claim 1 wherein component (A) is present at a level of about 0.5 to about 99% by weight of the additive composition.

18. The composition of claim 1 wherein component (B) is present at a level of about 0.2 to about 99% by weight of the additive composition.

19. The composition of claim 1 wherein component (C) is present at a level of about 0.5 to about 99% by weight of the additive composition.

20. The composition of claim 1 wherein the additive composition comprises a reaction product made by reacting the admixed components.

21. The composition of claim 20 wherein the reaction product comprises at least one salt.

22. A method for fueling an internal combustion engine, comprising fueling said engine with the fuel composition of claim 1.

23. A method for fueling an internal combustion engine, comprising fueling said engine with the fuel composition of claim 10.

* * * * *